US012716694B1

(12) United States Patent
Willits

(10) Patent No.: US 12,716,694 B1
(45) Date of Patent: Aug. 25, 2026

(54) LIGHTWEIGHT EFFECTIVE LASER ENGAGEMENT (LELE) LASER BEAM

(71) Applicant: BAE Systems Information and Electronic Systems Integration Inc., Nashua, NH (US)

(72) Inventor: John T. Willits, Pflugerville, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 712 days.

(21) Appl. No.: 18/309,233

(22) Filed: Apr. 28, 2023

(51) Int. Cl.
*H01J 13/00* (2006.01)
*F41H 13/00* (2006.01)

(52) U.S. Cl.
CPC ..... *F41H 13/0062* (2013.01)

(58) Field of Classification Search
CPC ..... H41H 13/0062; F41H 13/0062
See application file for complete search history.

(56) References Cited

U.S. PATENT DOCUMENTS

| | | | | |
|---|---|---|---|---|
| 4,990,919 | A | 2/1991 | Manoogian | |
| 5,495,787 | A | 3/1996 | Boyer, III | |
| 7,961,133 | B2 | 6/2011 | Vollin et al. | |
| 9,715,009 | B1 | 7/2017 | Parker et al. | |
| 9,891,027 | B2 | 2/2018 | Rahav et al. | |
| 10,907,940 | B1 | 2/2021 | Parker et al. | |
| 11,181,346 | B1 | 11/2021 | Barfoot et al. | |
| 11,248,879 | B1 | 2/2022 | Barfoot et al. | |
| 11,460,275 | B2 | 10/2022 | Factor et al. | |
| 2010/0282942 | A1* | 11/2010 | Mosier | G01S 7/4814 250/203.2 |
| 2014/0102288 | A1 | 4/2014 | Yeshurun et al. | |
| 2019/0195601 | A1 | 6/2019 | Finkenberg | |
| 2020/0072582 | A1 | 3/2020 | Factor et al. | |

* cited by examiner

*Primary Examiner* — Nicole M Ippolito
(74) *Attorney, Agent, or Firm* — Sand, Sebolt & Wernow LPA; Gary McFaline

(57) ABSTRACT

An optical system or laser assembly has a primary mirror in optical communication with an output coupler. The primary mirror receives the electromagnetic radiation and reflects the electromagnetic radiation to a steering mirror. The optical coupler can move an axis to vary a focal length between the output coupler and the primary mirror, which in turn, varies a conical shape of the electromagnetic radiation transmitted from the optical coupler. The primary mirror directs the electromagnetic radiation to the steering mirror and the steering mirror directs a focused beam of the electromagnetic radiation through the opening and out of the housing toward a target.

19 Claims, 6 Drawing Sheets

LIGHTWEIGHT EFFECTIVE LASER ENGAGEMENT (LELE) LASER BEAM

TECHNICAL FIELD

The present disclosure relates generally to focusing laser beams at a remote location.

BACKGROUND ART

Lasers can be used as countermeasures in both military and civilian applications to protect vehicles and personnel from incoming threats such as missiles, rockets, and drones. There are several types of lasers that can be used for this purpose, including the following: Continuous Wave (CW) Lasers: This type of laser produces a continuous beam of light and can be used for target illumination or to blind sensors on incoming threats. CW lasers are not typically used for destroying targets; Pulsed Lasers: These lasers emit high-energy pulses of light that can be used for blinding sensors, damaging sensors, or disabling incoming threats. Pulsed lasers can also be used for range finding and target tracking; High-Power Solid-State Lasers: These lasers use solid-state materials such as crystals or glasses as the gain medium to produce a high-power beam. They can be used for disabling incoming threats or destroying them; Gas Lasers: This type of laser uses a gas such as carbon dioxide or nitrogen as the gain medium. They can produce high-energy pulses or continuous beams of light and are typically used for range finding or target tracking; and Fiber Lasers: Fiber lasers use optical fibers as the gain medium and can produce high-power beams. They are typically used for cutting and welding, but can also be used for disabling incoming threats.

In terms of countermeasure lasers on land-based vehicles such as tanks, there are a few specific types that are commonly used: High-Energy Laser (HEL) Systems: These systems use high-power solid-state or gas lasers to disable or destroy incoming threats. HEL systems can be mounted on land-based vehicles and used to protect troops or convoys; Laser Dazzlers: These are low-power lasers that can be used to temporarily blind the sensors on incoming threats. They can be mounted on vehicles or handheld by personnel; and Laser Range Finders: These lasers are used to determine the distance to a target and can be used to aim weapons systems or calculate the trajectory of incoming threats.

Lasers have become an increasingly important technology for military countermeasures, with a range of applications across different types of land-based vehicles. While countermeasure lasers on land-based vehicles such as tanks have several advantages, there are also some drawbacks and deficiencies that should be considered, including: Limited Range: Countermeasure lasers typically have a limited effective range, especially when compared to other weapons systems such as guns or missiles. This can limit their effectiveness in certain scenarios, particularly against fast-moving targets at long distances; Power Requirements: High-energy lasers require a significant amount of power to operate, which can be a challenge on a vehicle-based platform where power supply may be limited. This can also increase the weight and size of the system, making it more difficult to install and transport; Atmospheric Conditions: Lasers can be affected by atmospheric conditions such as dust, smoke, or fog, which can reduce their effectiveness. This is particularly important for land-based vehicles that may be operating in areas with poor visibility or high levels of dust and debris; Cost: High-energy lasers can be expensive to produce and maintain, which can limit their widespread adoption in military applications. This cost can be particularly prohibitive for smaller vehicles or for militaries with limited budgets; and Vulnerability to Electronic Countermeasures: Laser systems can be vulnerable to electronic countermeasures such as jamming or interference, which can disrupt their operation or render them ineffective.

Overall, while countermeasure lasers have a range of potential benefits for land-based vehicles such as tanks, they also have several limitations that must be considered when selecting and deploying these systems in the field.

SUMMARY OF THE INVENTION

The present disclosure provides a lightweight effective laser engagement (LELE) configuration, which may be configured as a laser mast assembly that is an efficient laser distribution design that offers stabilized, large aperture, spot size control of an engagement laser. One exemplary embodiment of the present disclosure may be mounted on ground vehicles to provide defensive (destroy incoming ordinance), offensive (take down enemy drones), and power distribution capabilities (provide wireless power to friendly drones).

According to one exemplary embodiment, to achieve the large aperture necessary to produce a smaller focus on targets, the LELE utilizes reflective optics. This reduces the weight and expense while providing capability to both continuous and pulse laser sources. LELE is designed to enhance the effectiveness of CW lasers and short pulse laser engagement where high peak power on the target is most effective. By utilizing a large diameter primary mirror, a tighter focus can be maintained onto a target. Additionally, by not moving the primary mirror, fast and stabilized targeting is achieved by only spinning the outside mast and steering mirror to provide 360 degrees of coverage. Utilizing mirrors to image the laser is especially useful in not introducing dispersion for short pulse laser engagement, but it is also advantageous to for CW systems in providing a lightweight and inexpensive solution for large aperture optics.

In one exemplary embodiment, through control of the spacing between two curved mirrors or lenses, the LELE assembly can adjust the focus of the engagement laser which lends itself to additional capabilities such as optical power transmission to a friendly drone; so an untethered drone can fly endlessly. Optimal power can be provided by fully filling an optical rectifier.

One exemplary embodiment may provide an onboard camera that is imaged off the flat steering mirror to the side of the engagement laser (separate beam path) for targeting and to provide feedback for stabilization of the steering mirror (piezoelectric stacks). Additionally, an embodiment may have a rangefinder that is used to collect target range information that enables the position of secondary mirror to be adjusted vertically to tightly focus the engagement laser on target. All three systems, engagement laser, camera, and range finder benefit from the rapid targeting and stabilization of the flat steering mirror.

An exemplary intensity model of a LELE laser assembly demonstrates the effectiveness of a practical implementation of LELE laser assembly utilizing a 1000 W, 1064 nm CW source. The advantage of LELE laser assembly over a standard aperture is improved by a factor of 81. The intensity at the focus is proportional to the diameter of the aperture (D) squared. Meaning a simulated 9 times larger aperture diameter (27" LELE to 3" standard) corresponds 81 times the laser intensity at the focus.

In one aspect, an exemplary embodiment of the present disclosure may provide an optical and/or laser system, which may be a countermeasure system, the system comprising: a housing having a sidewall defining an interior space and the sidewall defining an opening that extends through the sidewall, wherein the housing has a first end and a second end, and a first axis extends centrally between the first end and the second end, wherein the housing is configured to rotate about the first axis; a steering mirror within the interior space of the housing, wherein the steering mirror rotates in unison with the housing about the first axis, wherein the steering mirror tilts relative to a second axis that is orthogonal to the first axis; a laser source; an output coupler in the interior space, wherein the output coupler is in optical communication with the laser source, wherein the output coupler transmits electromagnetic radiation in a conical shape, and wherein the output coupler is moveable along the first axis; a primary mirror in optical communication with the output coupler, wherein the primary mirror receives the electromagnetic radiation in the conical shape and reflects the electromagnetic radiation to the steering mirror, wherein movement of the output coupler along first axis varies a focal length between the output coupler and the primary mirror and varies the conical shape of the electromagnetic radiation transmitted from the optical coupler; wherein the primary mirror directs the electromagnetic radiation to the steering mirror and the steering mirror directs a focused beam of the electromagnetic radiation through the opening and out of the housing toward a target.

This exemplary embodiment or another exemplary embodiment may further provide or comprise: a focal length defined between the output coupler and the primary mirror; and a first position and a second position of the output coupler, wherein the output coupler is moveable between the first position and the second position, and wherein movement between the first position and the second position varies the focal length. This exemplary embodiment or another exemplary embodiment may further provide that the first position and the second position are on the first axis.

This exemplary embodiment or another exemplary embodiment may further provide or comprise a diameter of the primary mirror, wherein the diameter of primary mirrors is at least twice than a diameter of the output coupler. This exemplary embodiment or another exemplary embodiment may further provide that the diameter of the primary mirror is 27 inches.

This exemplary embodiment or another exemplary embodiment may further provide that the focused beam converges at point remote from the optical system, where an intensity of the focus beam is at its maximum at the point, where the target is located at the point where the intensity of the focused beam is at its maximum.

This exemplary embodiment or another exemplary embodiment may further provide or comprise a fixed installation of the primary mirror within the interior space of the housing, wherein the primary mirror remains stationary as the housing rotates about the first axis.

This exemplary embodiment or another exemplary embodiment may further provide or comprise: an imager or camera located within the interior space, wherein the imager or camera is adapted to capture an image of the target. This exemplary embodiment or another exemplary embodiment may further provide or comprise: a range finder located within the interior space, wherein the range finder is adapted to determine a distance to the target.

In yet another aspect, an exemplary embodiment of the present disclosure may provide a method comprising: generating a laser beam in a laser source; guiding the laser beam through an optical coupler; transmitting the laser beam from the optical coupler to a primary mirror; receiving the laser beam at the primary mirror; reflecting the laser beam from the primary mirror toward a steering mirror; directing the laser beam from steering mirror toward a target; and causing the laser beam to converge and focus an intensity of the laser beam on the target. This exemplary embodiment or another exemplary embodiment may further provide or comprise destroying the target with the laser beam.

This exemplary embodiment or another exemplary embodiment may further provide or comprise varying a focal length between the optical coupler and the primary mirror. This exemplary embodiment or another exemplary embodiment may further provide that varying the focal length is accomplished by moving the optical coupler from a first position to a second position along a central axis.

This exemplary embodiment or another exemplary embodiment may further provide or comprise rotating a mast about a first axis, wherein the steering mirror rotates in unison with the mast; and maintaining the primary mirror in a stationary position while the mast rotates about the first axis. This exemplary embodiment or another exemplary embodiment may further provide or comprise increasing the intensity of the laser beam, wherein the intensity of the laser beam is a function of a diameter of the optical coupler and a diameter of the primary mirror.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
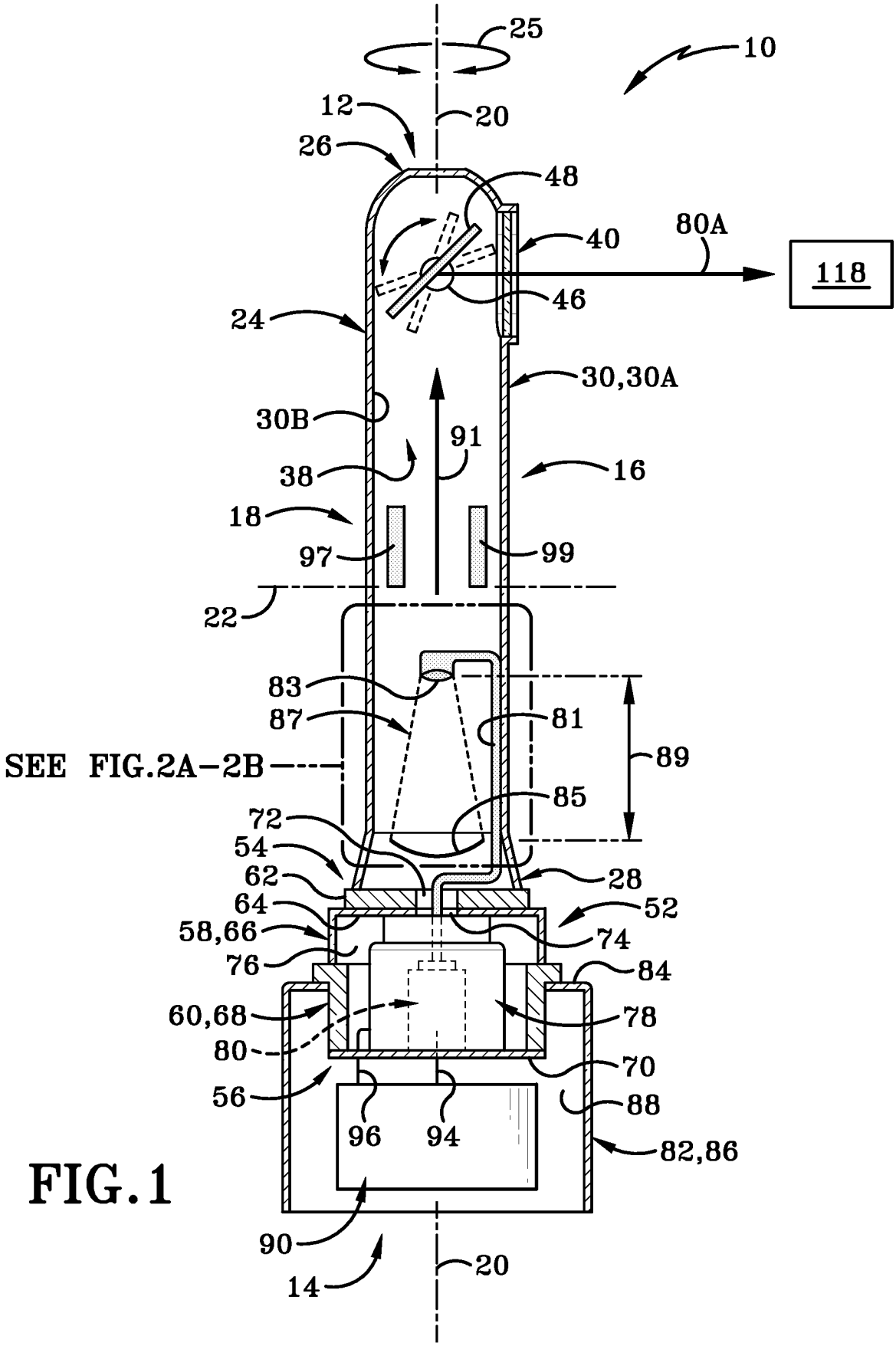
FIG. 1 (FIG. 1) is cross section view of an exemplary laser mast assembly according to one aspect of the present disclosure.

FIG. 1 depicts a LELE configured as a laser mast assembly 10. The laser mast assembly 10 includes a top end 12, a bottom end 14 that is opposite the top end 12, front side 16, and a back side 18 that is opposite the front side 16. A central vertical axis 20 extends between the top end 12 and the bottom end 14. A central horizontal axis 22 extends between the front side 16 and the back side 18. The central horizontal axis 22 is perpendicular to the central vertical axis 20.

The laser mast assembly 10 includes a mast 24. The mast 24 includes a top end 26 and a bottom end 28 that is opposite the top end 26. The mast 24 further includes a cylindrical wall 30. The cylindrical wall 30 extends longitudinally with respect to the central vertical axis 20 between the top end 26 and the bottom end 28 of the mast 24. The cylindrical wall 30 is generally cylindrical in shape and defines an outer surface 30A and an inner surface 30B. The top horizontal wall defines an outer surface and an inner surface. The inner surface 30B of the cylindrical wall 30 defined a chamber or interior space 38 of the mast 24. The chamber or interior space 38 extends longitudinally with respect to the vertical axis 20 between the top end 26 and the bottom end 28 of the mast 24.

The cylindrical wall 30 further defines an aperture 40. The aperture 40 extends between the outer surface 30A and the inner surface 30B of the cylindrical wall 30. The aperture 40 may include or retain a material with low optical attenuation at optical wavelengths emitted from the mast, including, but not limited to, sapphire glass, fused silica glass, or aluminum oxynitride. While the aperture 40 may be any shape, such as oval, square or rectangular. When the aperture 40 is sapphire glass, the sapphire glass may be coated with a material that optimizes the transparency of the sapphire glass as a function of an irradiance of a laser that exits the laser mast assembly 10 at the aperture 40.

The mast 24 further includes a pivot 46 and a flat steering mirror 48 that is connected to the pivot 46. Steering mirror 48 is configured to steer or direct a laser beam generated from the laser source 80, discussed in greater detail herein, outward through aperture 40 as beam 80A. Mirror 48 has a reflective surface that is flat.

The laser mast assembly 10 further includes a rotary stage 52. The rotary stage 52 includes a top end 54 and a bottom end 56 that is opposite the top end 54. The top end 54 of the rotary stage 52 is connected to the bottom end 28 of the mast 24. The rotary stage 52 further includes a rotatable portion 58 and a stationary portion 60. The rotatable portion 58 includes a disk 62, a top wall 64, and a cylindrical side wall 66. The disk 58 defines the top end 54 of the rotary stage 52. Hence, the disk 58 is connected to the bottom end 28 of the mast 24. The disk 58 is also connected to the top wall 64. This disk 58 extends longitudinally with respect to the central vertical axis 20 between the top wall 64 and the bottom end 28 of the mast 24. The top wall 64 extends longitudinally with respect to the central horizontal axis 22 between opposing sides of the cylindrical side wall 66. The stationary portion 60 includes a side wall 68 and a bottom wall 70. The bottom wall 70 extends longitudinally with respect to the central horizontal axis 22 between opposing sides of the side wall 68. The bottom wall 70 defines the bottom end 56 of the rotary stage 52.

The disk 62 defines a hole 72 that extends through the disk 62. The hole 72 is in open communication with the chamber 38. The top wall 64 defines a hole. The hole is in open communication with the hole 72. Hence the hole in the top wall 64 is in communication with the chamber 38. The top wall 64, the cylindrical side wall 66, the side wall 68, and the bottom wall 70 define a chamber 76.

The chamber 76 extends longitudinally with respect to the central vertical axis 20 between the top wall 64 of the rotatable portion 58 and the bottom wall 70 of the stationary portion 60. The chamber 76 extends longitudinally with respect to the central horizontal axis 22 between opposing sides of the cylindrical side wall 66 of the rotatable portion 58 and extends longitudinally with respect to the central vertical horizontal axis 22 between opposing sides of the side wall 68 of the stationary portion 60.

The rotary stage 52 includes a motor 78. The motor 78 may be within the chamber 76, however it could be in another location as well. The motor 78 is connected to the top wall 64 of the rotatable portion 58 and the bottom wall 70 of the stationary portion 60. The motor 78 drives the rotation of mast 24 about the vertical axis, as represented by arrow 25. The rotary stage 52 houses a laser source 80. In one embodiment, the laser source 80 is within the chamber 76. In this embodiment, the laser source 80 is connected to the bottom wall 70 of the stationary portion 60. In one embodiment, the laser mast assembly 10 may include at least one fiber optic cable 81 that extends from the laser source 80. The fiber optic cable 81 extends from the laser source 80 longitudinally though aperture 72 and into chamber 38. The fiber optic cable 81 may be carried by a metal cylinder that guides the fiber optic cable 81 from the laser source 80 into the chamber.

The laser source 80 is in optical communication with a lens or optical coupler 83 and a mirror 85. The optical coupler 83 may be physically connected to the an end of the fiber optic cable 81. Alternatively, the optical coupler 83 may be in indirect optical communication and not physically connected to the fiber optic cable 81. The optical coupler 83 is located above the mirror 85 with respect to axis 20. Optical coupler 83 is configured to transmit the laser towards the mirror 85 in a conical pattern, which is shown as optical cone pattern 87, which may simply be referred to as conical pattern 87.

The mirror 85 may be a concave curved mirror that receives the laser or electromagnetic radiation in the optical cone pattern 87 from the optical coupler 83. The mirror 85 then reflects that laser or electromagnetic radiation to the steering mirror 47, as shown by arrow 91. The laser or electromagnetic radiation of arrow 91 contacts steering mirror 48 and is steered outward from the laser mast assembly 10 through aperture 40 as beam 80A.

The mirror 85 is fixedly mounted within the lower portion of chamber 38, below the horizontal axis 22. The fixed mounting of mirror 85 within chamber 38 causes the mirror to remain stationary as the mast 24 or cylinder 30 rotates, as indicated by arrow 25, about axis 20. Mirror 85 is different and distinct from steering mirror 48 which is directly or indirectly coupled to the interior surface 30B of sidewall such that steering mirror rotates in unison with mast 24.

Mirror 85 has a diameter. The diameter of mirror 85 may be selectively chosen during manufacture of laser mast assembly 10. The diameter of mirror 85 should be selected to cause the mirror 85 and optical coupler 83 to collectively function similar to a telescope. Stated otherwise, the mirror 85 and optical coupler will cooperate to enlarge or magnify the intensity of the laser beam or electromagnetic radiation emitted in the conical pattern 87. Given that these two components cooperate to function as a or similar to a telescope, a focal length 89 is defined as the distance between optical coupler 83 and mirror 85. In one particular embodiment, the diameter of mirror 85 is 27 inches. However in other embodiments, the diameter of mirror 85 may range from about 12 inches to about 36 inches depending on the application specific needs of the laser mast assembly 10.

In one particular embodiment of the present disclosure, the optical coupler 83 is moveable in a direction that is parallel to or along the primary axis 20. This allows the focal length 89 to be variable which thereby varies the intensity of the laser beam or electromagnetic radiation that is ultimately transmitted out of laser mast assembly 10 as beam 80A.

Figure 2B:
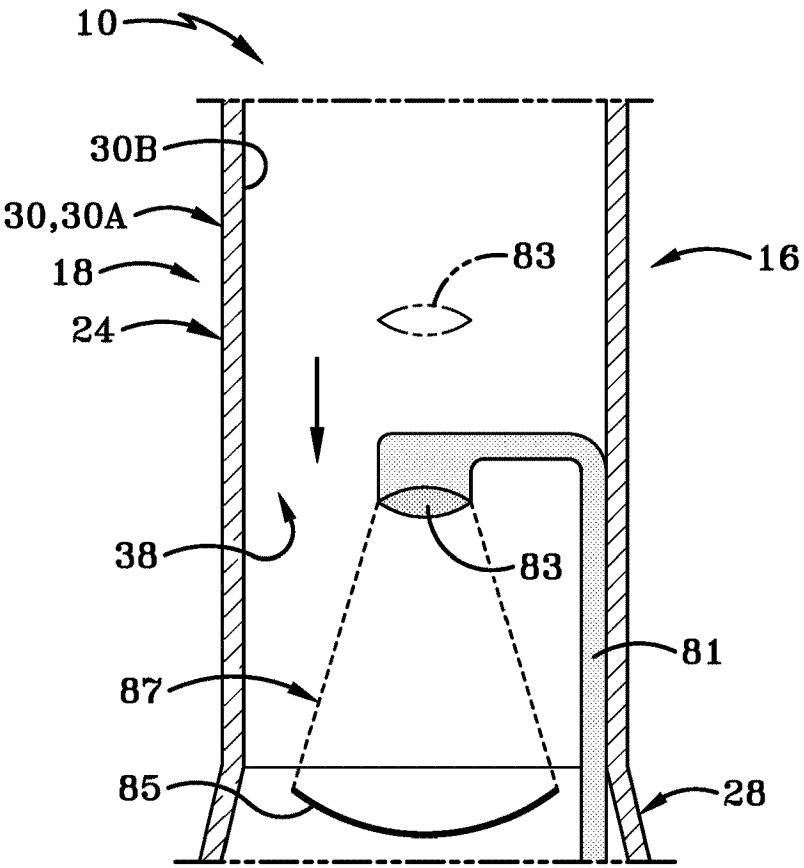
FIG. 2B (FIG. 2B) is an operational schematic view of decreasing a focal length between two optical elements.
Figure 2A:
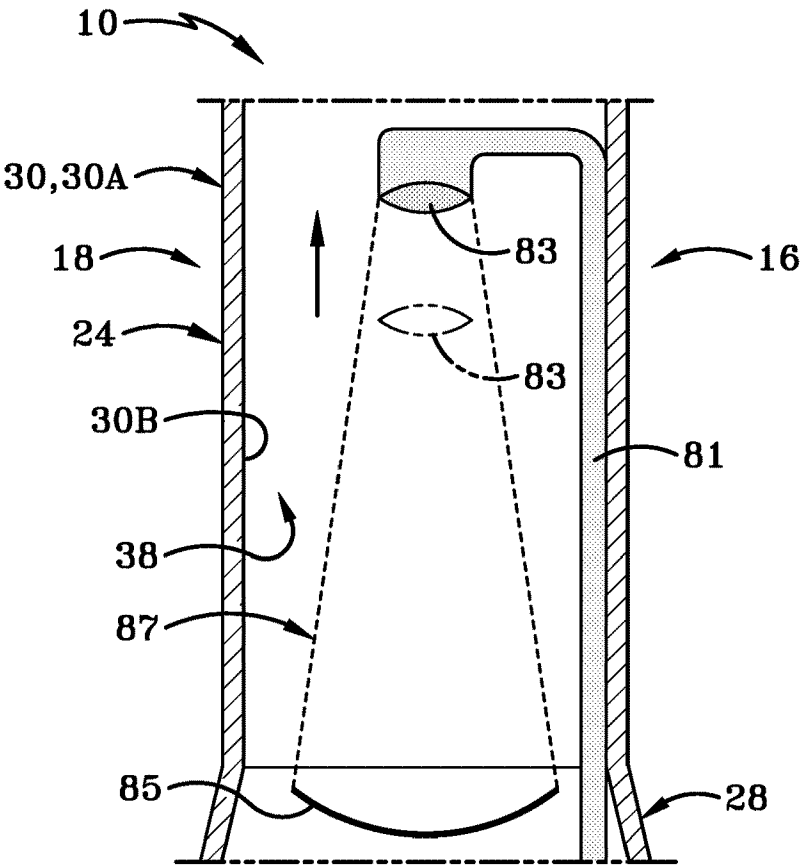
FIG. 2A (FIG. 2A) is an operational schematic view of increasing a focal length between two optical elements.

FIG. 2A depicts and exemplary embodiment in which the focal length of the telescope defined by optical coupler 83 and mirror 85 is increasing by moving the optical coupler 83 farther from mirror 85. Particularly, the optical coupler 83 started at a first position (shown in dashed lines) and has moved to a second position farther from the mirror 85. The increase in focal length 89 causes the optical cone pattern 87 to narrow.

FIG. 2B depicts and exemplary embodiment in which the focal length of the telescope defined by optical coupler 83 and mirror 85 is decreasing by moving the optical coupler 83 closer to the mirror 85. Particularly, the optical coupler 83 started at a first position (shown in dashed lines) and has moved to a third position closer to the mirror 85. The decrease in focal length 89 cause the optical cone pattern 87 to widen.

Referring back to FIG. 1, the installation or placement of the laser source 80 within or below the rotary stage 52 rather than above the rotary stage 52 may stabilize the laser mast assembly 10. That is, if the laser source 80 was above the rotary stage 52, the laser mast assembly 10 may become top heavy and may tip over when the vehicle 10 fires a projectile. As such, placing the laser source 80 below the rotary stage may stabilize the laser mast assembly 10.

The laser mast assembly 10 further includes a platform 82. The platform 82 is connected to the rotary stage 52. The platform 82 includes a top wall 84 and a cylindrical side wall 86. The top wall 84 of the platform 82 extends longitudinally with respect to the central horizontal axis 22 between opposing sides of the cylindrical side wall 86. The top wall 84 is connected to the side wall 68 of the stationary portion 60 of the rotary stage 52. The cylindrical side wall 86 extends longitudinally with respect to the central vertical axis 20 from the top wall 84. The top wall 84 and the cylindrical side wall 86 define a chamber 88. The chamber 88 extends longitudinally with respect to the central horizontal axis 22 between opposing sides of the cylindrical vertical wall 86. The laser mast assembly 10 further includes a logic 90. A field programmable gate array (FPGA) of logic 90 may be within the chamber 88. In one embodiment, the laser source 80 may be within the chamber 88. In this embodiment, the bottom wall 70 may define an aperture that extends through the bottom wall 70. In this embodiment, the aperture of the bottom wall 70 is in open communication with the chamber 76 of the rotary stage 52 and is in open communication with the chamber 88 of the platform. Hence, the chamber 88 is in open communication with the chamber 38 of the mast 24.

The logic 90 is connected to the laser source 80 via at least one wire 94 and is connected to the motor 78 via at least one wire 96. Logic 90 may additionally be in wired communication with a motor that controls the tilting function of steering mirror 48 about pivot 46.

Figure 3:
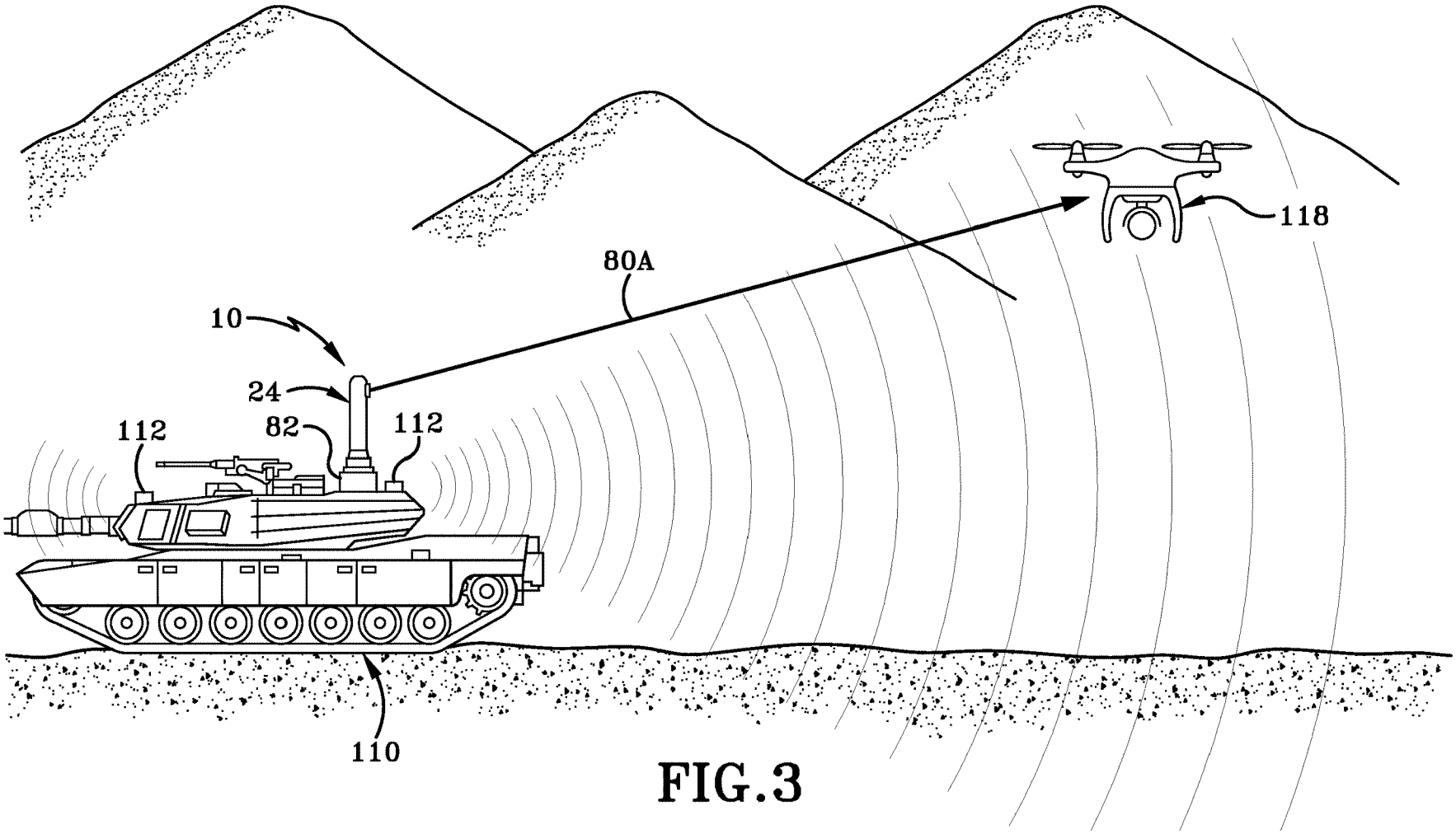
FIG. 3 (FIG. 3) is a diagrammatic environmental view of the laser mast assembly on a vehicle.

FIG. 3 depicts the laser mast assembly 10 connected to a vehicle 110. The vehicle 110 includes at least one threat detector 112. While the vehicle 110 is depicted as a tank, the vehicle 110 may be any vehicle 110 (i.e., a light armored vehicle, an infantry fighting vehicle, an armored personnel carrier, etc.). Further, the vehicle need not be a land-based vehicle, as shown. Vehicle 110 may be a sea-based vehicle or an air-based (or space-based) vehicle, regardless of whether the vehicle is manned or unmanned. Additionally, the term vehicle is also used herein to refer to stationary objects such as a tower or other fixed structure to which the laser mast assembly 10 may be mounted.

FIG. 3 further depicts an object that is remote from the laser mast assembly 10. In one embodiment, the object is a threat 118 that is remote from the vehicle 110. The threat 118 may be an enemy drone or unmanned aerial vehicle (UAV). Alternatively, the threat 118 may be a missile, rocket propelled grenade or other munition that intends to harm the vehicle 110. As detailed herein, the laser mast assembly 10 can be utilized to disable or neutralize the threat 118 by focusing high intensities of laser beam 80A on the threat 118. However, other embodiments provide for the remote object being a friendly object that can be remotely powered by the laser beam 80A if the intensity of beam 80A is decreased or lessened.

As shown in FIG. 3, the threat detector 112 detects the threat 118. The threat detector 112 may be any detector that is capable of detecting the threat 118 relative to the vehicle 110. In one embodiment, the threat detector 112 includes an optical camera. In this embodiment, four optical cameras are positioned at four corners of the vehicle 110 thereby providing a 360° view from the vehicle 110. However, the threat detector 112 could be another type of threat detector, such as one that utilizes radio frequencies to detect threat 118.

The threat detector 112 determines an angle of arrival of the threat 118 relative to a center of the laser mast assembly 10, wherein the center of the laser mast assembly 10 defines an origin of a standard Cartesian plane. The threat detector 112 is connected to and in communication with the logic 90 of the laser mast assembly 10. When the threat detector 112 detects the threat 118, the threat detector 112 sends a signal indicative of an incoming threat to the laser mast assembly 10. The signal indicative of an incoming threat includes the determined angle of arrival of the threat 118.

Returning briefly to FIG. 1, the motor 78 causes the rotatable portion 58 of the rotary stage 52 to rotate. Since the disk 62 of the rotary stage 52 is connected to the mast 24, rotating the disk 62 rotates the mast 24. Hence, the motor 78 rotates the mast 24. The motor 78 may rotate the mast 24 to rotate 360° about axis 20 as indicated by arrow 25. While the vehicle 110 is in operation the mast 24 may be constantly rotating. When the logic 90 receives the signal indicative of the incoming threat, the logic 90 sends a signal indicative of the determined angle of arrival to the motor 78 via the plurality of wires 96 which causes the motor 78 to rotate the mast 24 to the determined angle of arrival such that the aperture 40 is oriented along the determined angle of arrival so that the aperture 40 faces the threat 118. The plurality of wires 96 may include motor position +/−wires and motor status +/−wires. The logic 90 may send the signal indicative of the determined angle of arrival to the motor 78 via the motor position +/−wires. Furthermore, the motor 78 may send signals indicative of the status of the motor 78 to the logic 90 via the motor status +/−wires. The signals indicative of the status of the motor 78 may include signals indicative of the current and temperature of the motor 78.

In one embodiment, the vehicle 110 may be moving when the threat detector 112 detects the threat 118 relative the vehicle 110. In this embodiment, the threat detector 112 continuously updates the angle of arrival relative to the laser mast assembly 10 as the vehicle 110 is moving and continuously sends signals indicative of an incoming threat to the logic 90. The signals indicative of the incoming threat includes the updated angle of arrival. In another embodiment, the laser mast assembly 10 may contain an inertial measurement unit (IMU), and/or a camera 97, and/or a range finder 99 which allows for tracking the threat 118. The IMU and/or a camera 97, and/or a range finder 99 continuously provides vehicle motion information or threat 118 location information to logic 90 that may be used to recalculate the angle of threat 118 relative to the vehicle as the vehicle moves. As such, the mast 24 continuously rotates to the updated angle of arrival such that the aperture 40 are continuously oriented along the updated angle of arrival relative to threat 118 so that the aperture 40 continuously faces the threat 118.

In another embodiment, the vehicle 110 may be stationary when the threat detector detects the threat 118 to the vehicle 110 is detected. In this embodiment, the threat detector 112 continuously determines the angle of arrival as the same angle of arrival as the originally determined angle of arrival. The threat detector 112 continuously sends signals indicative of the incoming threat to the logic 90 that includes a same angle of arrival as the originally determined angle of arrival to the laser mast assembly 10. Accordingly, when the vehicle 110 is stationary, the mast 24 does not continue to rotate.

The logic 90 sends a signal to the motor of the steering mirror 48 via wires. These wires may include uplink +/−wires and downlink +/−wires that allow the logic 90 to communicate with the motor and/or steering mirror 48. The logic 90 may send the signal along the uplink +/−wires. The signal includes instructions to pivot the mirror 48 as a function of the determined position of the threat. In response to receiving the signal, the second logic causes the tilting motor to pivot the mirror 48 about pivot 46 as a function of the signal. For example, the threat detector 112 may determine that the position of the threat is 15° angle higher than the horizontal axis 22 of the laser mast assembly 10. In this example, the logic 90 sends the signal to pivot the mirror 48 to an angle that corresponds to 15° higher than the horizontal axis 22 of the laser mast assembly 10. After causing the mirror 48 to pivot, the logic sends a signal indicative of the position of the mirror 48 via the of wires. The logic may receive the signal to the via the downlink +/−wires. In response to the receiving the signal, the logic 90 determines if position of the second mirror 48 corresponds to the determined position of the threat 118. If it does not, then the logic 90 sends a signal to the second logic that causes the mirror 48 to pivot as a function of the determined positon of the threat 118.

After rotating to the determined angle of arrival, the logic 90 sends a first fire signal to the laser source 80 via the plurality of wires 94. The plurality of wires 94 may include trigger +/−wires that carry the fire signals to the first laser source 50 and the laser source 80. The plurality of wires 94 may further include laser interlock +/−wires that may prevent the second laser source 80 from misfiring.

In response to receiving the first fire signal, the laser source 80 emits a beam 80A. Beam 80A reflects off of the mirror 48, exits the mast 24 and strikes the threat as a sufficiently high intensity to disable the threat 118. More particularly, in response to receiving the fire signal, the laser source 80 emits laser 80A. The laser reflects off of the second mirror 48 and exits the mast 24 at the aperture 40. Since the mast 24 has rotated to the determined angle of arrival and since the mirror 48 has rotated in unison with mast 24 as a function of the determined positon of the threat 118, the laser 80A exits the mast 24 toward the threat 118. The plurality of wires 94 that connect the laser source 80 to the logic 90 may include trigger +/−wires and sync +/−wires that allow the logic 90 to synchronize the firing of the laser 80A. In one embodiment, the laser source 80 may be capable of emitting beam 80A with different intensities depending on the focal length 89 after having moved the optical coupler 83 relative to curved mirror 85.

The beam 80A may be emitted from laser mast assembly 10 in an annular beam shape (radial polarization) that is implemented to further increase intensity at a focus point. Wherein the logic 90 sets the focus point of the intensity on the threat 118 such that the high intensity focus of beam 80A on the threat 118 will cause the beam 80A to disable or destroy the threat 118.

The beam 80A utilizes a Gaussian beam focus. The intensity is focused on the threat 118 based on the aperture diameter, wavelength, focus diameter and range. In this Gaussian focused beam 80A, $$NA = n * \sin\left[\operatorname{atan}\left[\frac{D}{2L}\right]\right] \approx \frac{D}{2L} \text{ and} \quad \text{(Equation 1)}$$

$$d = \frac{\lambda}{2NA} \approx = \frac{\lambda}{2\left[n\frac{D}{2L}\right]} \approx \frac{\lambda L}{nD} \quad \text{(Equation 2)}$$

Where NA is the numerical aperture, D is the aperture diameter, A is the wavelength, d is the focus diameter and L is the range between mast assembly 10 and target 118, and n is the index of refraction. Assembly 10 may also account for the amount of energy lost over the range L based on different atmospheric conditions. The absorption of laser radiation in the atmosphere depends on the wavelength of the laser and weather conditions. One practical application of assembly 10 is to focus moderate high power (1000 W) CW energy from a fiber laser. Many inexpensive and robust commercial fiber lasers exist for 1064 nm.

The improvement in intensity (*I*) is expected with the reduced spot size, the area (A) that the power (P) is distributed on is reduced by a factor of $d^2$.

$$I = \frac{P}{A} = \frac{P}{\pi(d/2)^2} = \frac{P}{\pi\left[\frac{\lambda L}{2nD}\right]^2} = \frac{4PD^2}{\pi(\lambda L)^2} \quad \text{(Equation 3)}$$

The intensity at the focus is proportional to the diameter of the aperture (D) squared. Meaning a 10 times increase in aperture diameter corresponds to a 100 times improvement in focus intensity.

Figure 4:
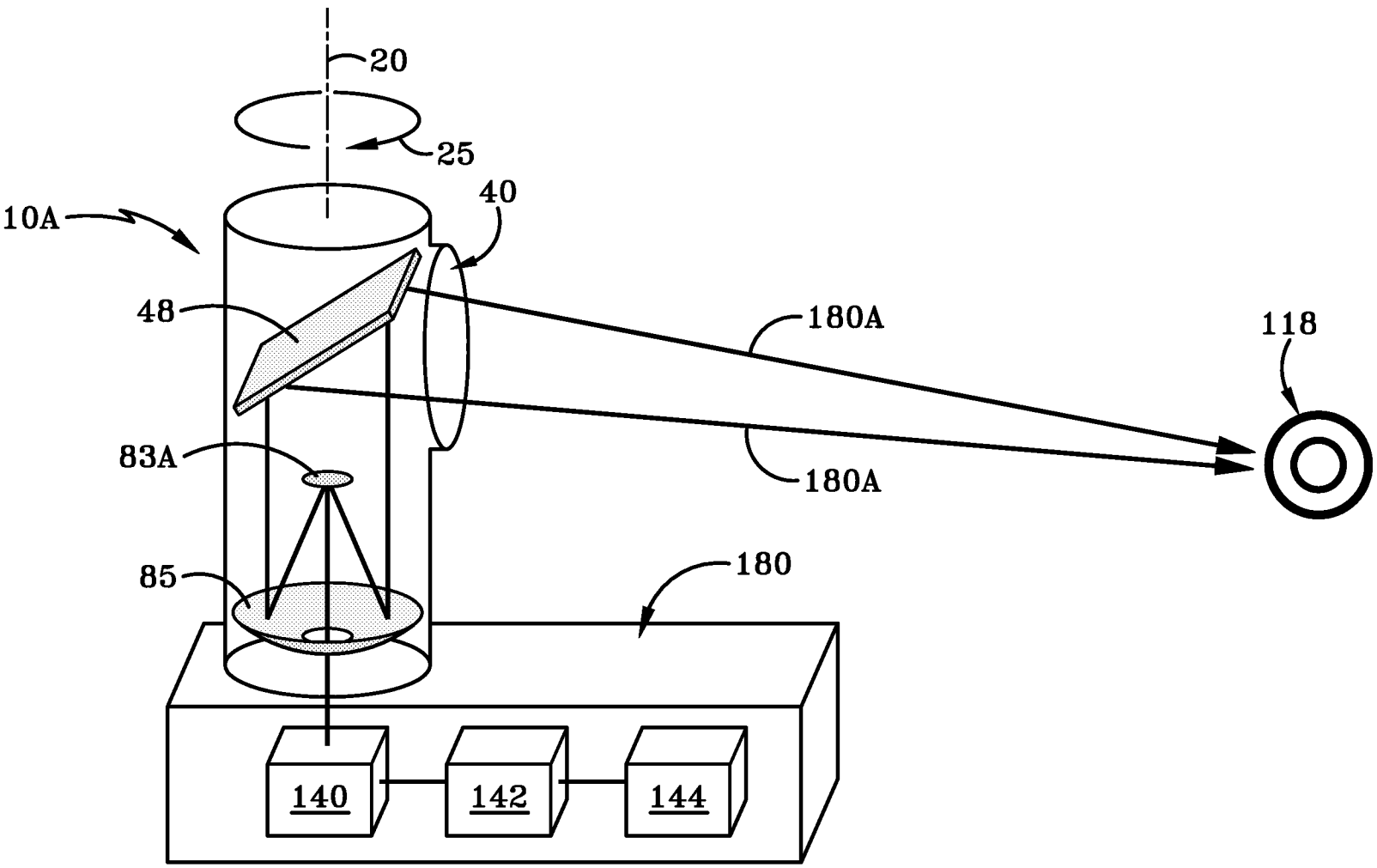
FIG. 4 (FIG. 4) is a schematic view of an alternative embodiment of a laser mast assembly that utilizes a free space laser source.

FIG. 4 depicts an alternative embodiment of the laser mast assembly 10A that utilizes a free-space laser generator or laser source 180 rather than a fiber optic laser. Laser source 180 may include a mode shape control 140, a pulse shaper 142, and a short pulse source 144. The mode shape control 140, the pulse shaper 142, and the short pulse source 144 are in optical communication with each other. The laser source 180 is in optical communication with lens 83A and primary mirror 85A. Mirror 85A is located within mast 24. Mirror 85A is a concave or flat annular mirror having an open center that is centered along axis 20. The laser beam from source 180 is projected upward to lens 83A. Lens 83A reflects the beam downward in the optical cone pattern 87 toward the mirror 85A. Mirror 85A directs the beam toward steering mirror 48 which then directs the beam 180A outward from mast 24 to focus the intensity of beam 180A onto target 118. In this example, the mirror 85A and lens 83A define a portion of the telescope. The use of the annulus or annular shaped mirror 85A enables the telescope to be made smaller than other embodiments. Laser beam mode shape control 140 should be converted to an annulus before entering the ring telephoto lens or mirror 85A. The focus of an annulus mode shape is smaller than that of a Gaussian (same diameter) for high energy laser beams due to Kerr lensing effect in air. Therefore, this provides size-weight and high intensity performance enhancements over larger telescopes.

Figure 5:
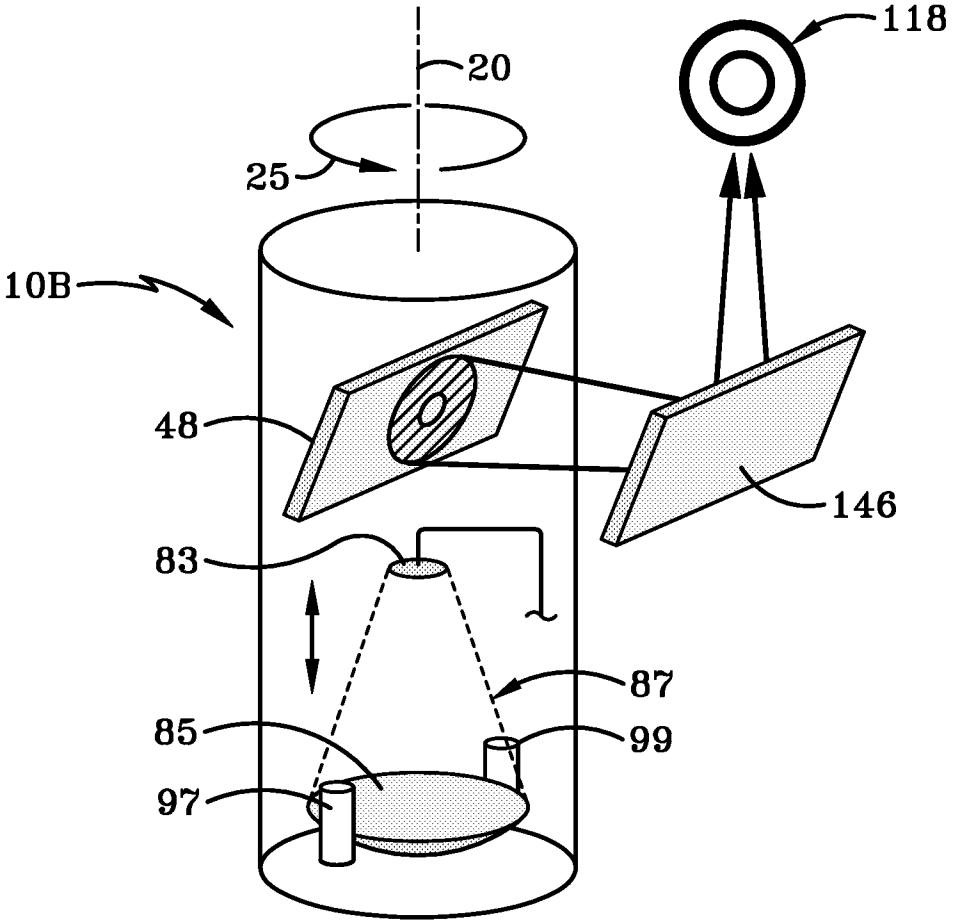
FIG. 5 (FIG. 5) is a schematic view of an alternative embodiment of a laser mast assembly that utilizes a second steering mirror to direct a beam directly above the vehicle.

FIG. 5 depicts another embodiment of laser mast assembly 10B that utilizes a second steering mirror 146 that is optically subsequent to steering mirror 48. Second steering mirror 146 enables the projected beam (either 80A or 180A) to be directed directly vertical and parallel to axis 20. This allows the assembly 10B to direct its beam towards a target 118 that is located above the vehicle 110. Second steering mirror 146 may be pivot about its own pivot axis to steer the projected beam within +/−20° of the vertical axis 20, if desired.

Having thus generally described the configuration of laser mast assembly 10, reference will now be made to its operation and operational advantages.

With continued reference to FIGS. 1-3B, laser mast assembly 10 provides a technique that provides a very tightly focused, high intensity laser beam 80A onto an object, such as threat 118. Notably, the object does not need to be a threat 118 and it could be a friendly device that is to be remote powered by beam 80A. However, when the object is a threat 118, such as a drone, the laser mast assembly 10 provides an advantage of a relatively low cost countermeasure defensive device. Particularly, a drone threat 118 is relatively inexpensive to deploy for an enemy. Thus, when the vehicle could launch at the threat 118, like guided missiles, for instance, they are very expensive when compared to the cost of a drone threat.

Laser mast assembly 10 provides unique advantages over other technologies that increase the amount of laser power and direct that high power beam on the threat 118, which require significantly more power, and much of that light or energy misses the object. Since much of the energy misses the object, the beam must be directed on the object for a longer dwell time. Another downside in these other technologies is that the laser sources are expensive because they are required to be so powerful.

Laser mast assembly 10 provides a smaller, more lightweight and therefore more efficient laser emitter to focus a small tightly focused intensity onto a target or object, such as threat 118. Thus, laser mast assembly 10 is able to not waste beam 80A or 180A energy. Further, the tightly focused beam 80A or 180A on the threat 118 creates more damage on the threat 118, similar to the effect of laser drilling into the threat 118. Essentially, beam 80A or 180A is a high intensity and focused source of energy at a point in space that is remote from the vehicle 110.

The intensity of the beam 80A is related to the diameter of mirror 85, and more particularly, a diffraction limited spot size. Laser mast assembly 10 takes the advantages of having a large telescope (defined by optical coupler 83 and mirror 85) and stabilize beam 80A while pointed in any direction relative to axis 20. This is accomplished by the rotation of steering mirror 48 about 360 degrees of coverage as indicated by arrow 25 coupled with the ability to tilt the mirror about the pivot 46. In one embodiment, the mirror may tilt in a range from about 20 degrees above and 20 degrees below the horizontal axis 22. The same is applicable for assembly 10A with beam 180A.

One exemplary advantage of laser mast assembly 10 or 10A is that not all of the components within chamber 38 move or rotate. For example, in one embodiment, the components that define the telescope, such as the optical coupler 83 and mirror 85 do not rotate about axis 20 and remain fixed in a single position and orientation within chamber 38. This is advantageous inasmuch as it reduces the likelihood for components to break or become misaligned. Further, it should reduce weight by eliminating extra motors, gimbals or the like that would effectuate the rotation of the telescope. By maintaining at least the mirror 85 stationary, the mast 24 of assembly 10 or 10A is able to move faster than if the mirror 85 also needed to rotate.

With reference to the laser or electromagnetic radiation exiting the optical coupler 83 on the telescope, it forms the optical cone pattern 87. The optical cone pattern 87 is determined by the variable focal length 89. Mirror 85 will largely or mostly collimate the beam reflected from the optical cone pattern 87. The mostly collimated beam is controlled by the focal length 89 variability or adjustability. The movement of the optical coupler 83 relative to mirror 85 may be accomplished via a servo motor that is coupled to logic 90. Alternatively, it may be possible to eliminate the motors associated with varying the focal length and create a digitally variable focal length.

In operation, the camera 97 and/or rangefinder 99 will enable the logic 90 to process the target 118 positional data. Another embodiment of the present disclosure can use the telescoping ability to image the camera 97 through the telescope to focus in and observe target 118. This allows laser mast assembly to control the focus and provide that information to the camera so that the camera can lock onto the target 118. This would allow for the camera 97 to be used for detection and tracking, as well as for actual engagement. The range finder 99 may be used for determining the distance to the threat 118, which assists in tracking and engagement.

In this embodiment, the assembly 10 or 10A is used to disable the target 118. When the beam 80A or 180A is focused on target 118 with a high enough intensity, it will cause ablation damage to body, battery and/or the motors that are driving the target 118, especially when target 118 is a drone. In one embodiment, the target 118 is powered by a lithium ion battery. The beam 80A or 180A is directed to the battery on target 118 which will cause ablation of the battery and cause it to exploded to disable the target 118. However, the advantage of beam 80A or 180A causing ablation can be universally applied as a countermeasure to any type of threat or munition.

FIG. 4 depicts that other laser mast assemblies can have other types of laser sources, such as the free space laser 180. This embodiment injects laser light through the hole in the primary mirror 85A in the center. This laser transmits up through the center of the primary mirror 85A, up to the secondary small mirror or lens 83A, Then, the light reflects back down to create the cone pattern 87, up to the steering mirror 48, and then out to the target 118.

Assembly 10A may also create short pulses to provide tight control over space and time. Thus, the temporal pulse shaper can pre-shape the beam in time. The mode shape control can shape it in space and it may also account for atmospheric conditions to provide a dynamic mode shape. There may be a wave front corrector may pre-correct for what the laser light is doing as it makes its way to the target 118.

FIG. 4 also may provide a more optimal laser mast assembly that provides a narrow focus aperture to increase the intensity at threat 118. This is accomplished by the annulus or donut-shape of mirror 85A. This allows for a wider cone pattern 87. This is effectuated by the mode shape control to alter the output from a Gaussian mode shape to an annular shape. This should assist in reducing or eliminating laser power loss. This annular mode shape may be advantageous because it matches with a small telescope. This allows for assembly 10A to reduce size and weight while maintaining performance. This annulus or annular mode shape may be superior to a Gaussian mode shape when the assembly is focusing the beam at target 118 at high intensities with a short pulse laser. Short pulse lasers that are focused in space and time have a tendency to change the diffraction of the air that it is moving through (i.e., the Kerr lensing effect). To overcome the Kerr lensing effect, the assembly 10A can mode shape the laser light into an annulus instead of being a Gaussian shape.

Although the embodiments discussed heretofore have been disclosed with an eye toward disabling a threat 118, another embodiment of the present disclosure may be used in a constructive manner. Namely, a beam 80A or 180A may be altered to lessen its intensity so that it can be used for optical power transmission or energy transfer. A friendly drone may be equipped with a photovoltaic cell to harvest energy from a beam 80A or 180A and transmit the harvested power from the photovoltaic cell to charge a battery on the friendly drone. One exemplary photovoltaic cell is 51% efficient at a specific wave length. The intensity of the focused beam 80A or 180A is lessened such that the spot size is increased but still directed or pointed at the photovoltaic cell on the friendly drone, which enables the friendly drone to be remotely powered.

The assembly of the present disclosure may additionally include one or more sensor to sense or gather data pertaining to the surrounding environment or operation of the assembly. Some exemplary sensors capable of being electronically coupled with the assembly (either directly connected to the assembly of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Figure 6:
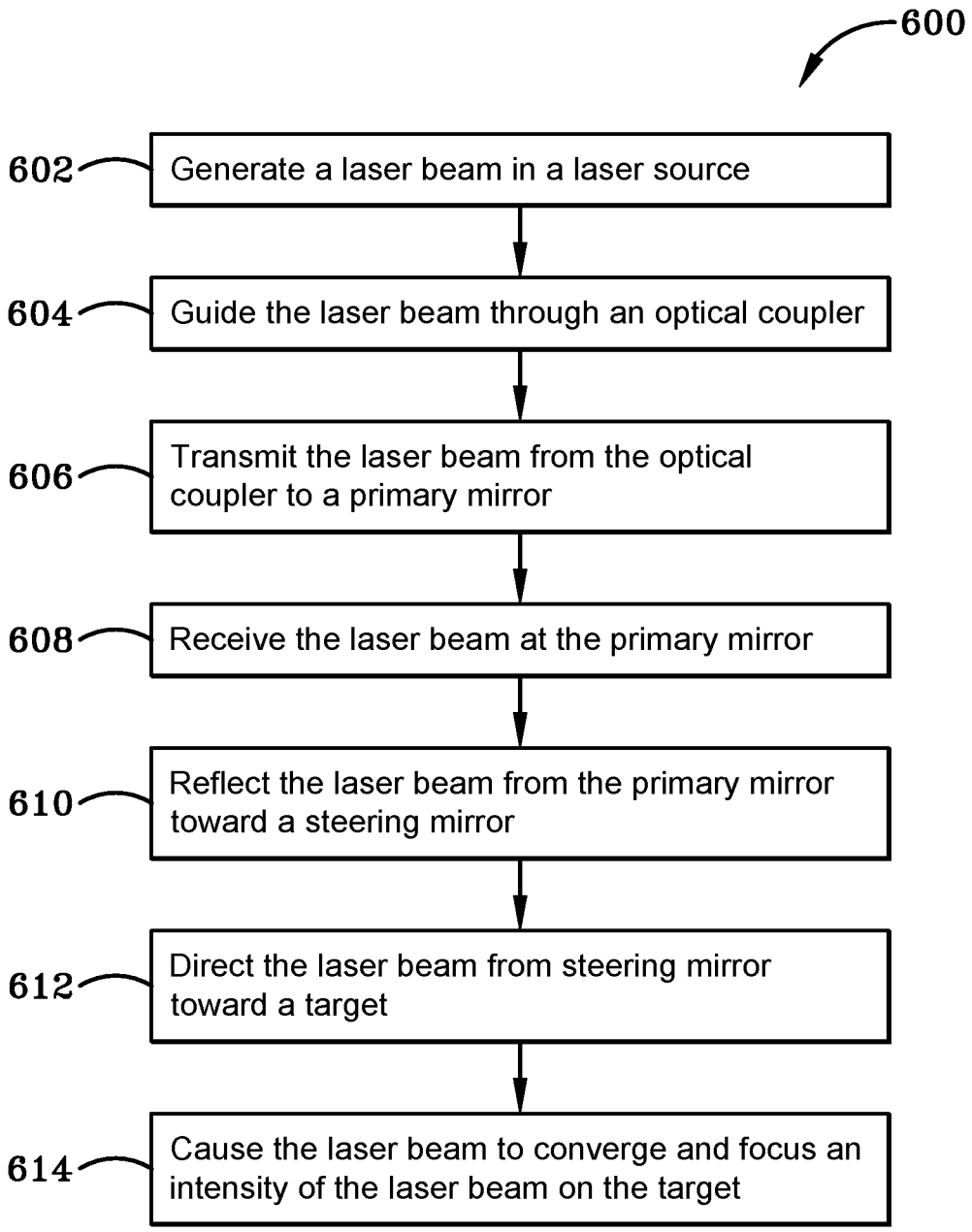
FIG. 6 (FIG. 6) is a flow chart that depicts an exemplary method according to one aspect of the present disclosure.

For example, FIG. 6 depicts an exemplary method of the present disclosure, which is shown generally at 600. Method 600 includes generating a laser beam in a laser source, which is shown generally at 602. Method 600 includes guiding the laser beam through an optical coupler, which is shown generally at 604. Method 600 includes transmitting the laser beam from the optical coupler to a primary mirror, which shown generally at 606. Method 600 includes receiving the laser beam at the primary mirror, which is shown generally at 608. Method 600 includes reflecting the laser beam from the primary mirror toward a steering mirror, which is shown generally at 610. Method 600 includes directing the laser beam from steering mirror toward a target, which is shown generally at 612. Method 600 includes causing the laser beam to converge and focus an intensity of the laser beam on the target, which is shown generally at 614.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of components A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment,"

"an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. An optical system comprising:

a housing having a sidewall defining an interior space and the sidewall defining an opening that extends through the sidewall, wherein the housing has a first end and a second end, and a first axis extends centrally between the first end and the second end, wherein the housing is configured to rotate about the first axis;

a steering mirror within the interior space of the housing, wherein the steering mirror rotates in unison with the housing about the first axis, wherein the steering mirror tilts relative to a second axis that is orthogonal to the first axis;

a laser source;

an output coupler in the interior space, wherein the output coupler is in optical communication with the laser source, wherein the output coupler transmits electromagnetic radiation, and wherein the output coupler is moveable along the first axis;

a primary mirror in optical communication with the output coupler, wherein the primary mirror receives the electromagnetic radiation from the output coupler and reflects the electromagnetic radiation to the steering mirror, wherein movement of the output coupler along the first axis varies a focal length between the output coupler and the primary mirror; and wherein the steering mirror directs a focused beam of the electromagnetic radiation through the opening and out of the housing toward a target.

2. The optical system of claim 1, further comprising:

a first position and a second position of the output coupler, wherein the output coupler is moveable between the first position and the second position, and wherein movement between the first position and the second position varies the focal length.

3. The optical system of claim 2, wherein the first position and the second position are on the first axis.

4. The optical system of claim 1, further comprising:

a diameter of the primary mirror, wherein the diameter of primary mirrors is at least twice than a diameter of the output coupler.

5. The optical system of claim 4, wherein the diameter of the primary mirror is 27 inches.

6. The optical system of claim 1, wherein the focused beam converges at point remote from the optical system, where an intensity of the focus beam is at its maximum at the point, where the target is located at the point where the intensity of the focused beam is at its maximum.

7. The optical system of claim 1, further comprising:

a fixed installation of the primary mirror within the interior space of the housing, wherein the primary mirror remains stationary as the housing rotates about the first axis.

8. The optical system of claim 1, wherein the steering mirror is a flat steering mirror that causes the focused beam to converge in intensity at the target.

9. The optical system of claim 1, further comprising:

a reflective surface on the steering mirror, wherein the reflective surface on the steering mirror is flat.

10. The optical system of claim 1, further comprising:

an imager or camera located within the interior space, wherein the imager or camera is adapted to capture an image of the target.

11. The optical system of claim 1, further comprising:

a range finder located within the interior space, wherein the range finder is adapted to determine a distance to the target.

12. The optical system of claim 1, further comprising:

a reflective surface on the primary mirror, wherein the reflective surface on the primary mirror is concave.

13. The optical system of claim 1, wherein the output coupler is a lens.

14. A method comprising:

providing an optical system that includes:

a housing having a sidewall defining an interior space and the sidewall defining an opening that extends through the sidewall, wherein the housing has a first end and a second end, and a first axis extends centrally between the first end and the second end, wherein the housing is configured to rotate about the first axis;

a steering mirror within the interior space of the housing, wherein the steering mirror rotates in unison with the housing about the first axis, wherein the steering mirror tilts relative to a second axis that is orthogonal to the first axis;

a laser source;

an output coupler in the interior space, wherein the output coupler is in optical communication with the laser source, wherein the output coupler transmits electromagnetic radiation, and wherein the output coupler is moveable along the first axis;

a primary mirror in optical communication with the output coupler, wherein the primary mirror receives the electromagnetic radiation from the output coupler and reflects the electromagnetic radiation to the steering mirror, wherein movement of the output coupler along the first axis varies a focal length between the output coupler and the primary mirror;

wherein the optical system that is provided is adapted to:

generate a laser beam in the laser source;

guide the laser beam through the optical coupler;

transmit the laser beam from the optical coupler to the primary mirror;

receive the laser beam at the primary mirror;

reflect the laser beam from the primary mirror toward the steering mirror;

direct the laser beam from steering mirror toward a target; and cause the laser beam to converge and focus an intensity of the laser beam on the target.

15. A method comprising:

generating a laser beam in a laser source;

guiding the laser beam through an optical coupler;

transmitting the laser beam from the optical coupler to a primary mirror;

receiving the laser beam at the primary mirror;

reflecting the laser beam from the primary mirror toward a steering mirror;

directing the laser beam from steering mirror toward a target; and varying a focal length between the optical coupler and the primary mirror; and causing the laser beam to converge and focus an intensity of the laser beam on the target.

16. The method of claim 15, further comprising:

destroying the target with the laser beam.

17. The method of claim 15, wherein varying the focal length is accomplished by moving the optical coupler from a first position to a second position along a central axis.

18. The method of claim 15, further comprising:

rotating a mast about a first axis, wherein the steering mirror rotates in unison with the mast; and maintaining the primary mirror in a stationary position while the mast rotates about the first axis.

19. The method of claim 15, further comprising:

increasing the intensity of the laser beam, wherein the intensity of the laser beam is a function of a diameter of the optical coupler and a diameter of the primary mirror.

* * * * *